US005427077A

United States Patent [19]

Gilbert

[11] Patent Number: 5,427,077

[45] Date of Patent: Jun. 27, 1995

[54] APPARATUS FOR DELIVERING A VOLATILE COMBUSTIBLE VAPOR AND ATMOSPHERIC AIR MIXTURE TO INTERNAL COMBUSTION ENGINES

[75] Inventor: Jack J. Gilbert, Alpharetta, Ga.

[73] Assignee: Gasifier Corporation, Shelby Township, Mich.

[21] Appl. No.: 224,281

[22] Filed: Apr. 7, 1994

[51] Int. Cl.[6] ..... F02M 17/22

[52] U.S. Cl. ..... 123/522; 261/64.4; 261/107; 261/DIG. 83

[58] Field of Search ..... 123/522, 523, 524; 261/64.3, 64.4, 107, DIG. 83

[56] References Cited

U.S. PATENT DOCUMENTS

| | | | |
|---|---|---|---|
| 349,211 | 9/1886 | Cottrell . | |
| 527,639 | 10/1894 | Westcott . | |
| 1,180,389 | 4/1916 | Friend | 261/64.4 |
| 1,598,243 | 8/1926 | Chapin . | |
| 1,883,142 | 10/1932 | Wannack . | |
| 1,889,162 | 11/1932 | Thomas et al. . | |
| 2,351,072 | 6/1944 | Schmidt | 48/180 |
| 2,565,767 | 8/1951 | Gaskell | 62/168 |
| 3,338,223 | 8/1967 | Williams | 123/134 |
| 3,986,846 | 10/1976 | Bivins | 48/180 |
| 4,149,853 | 4/1979 | DesMarais et al. | 44/50 |
| 4,270,505 | 6/1981 | Johnson | 123/523 |
| 4,271,098 | 6/1981 | Henning et al. | 261/66 |
| 4,426,984 | 1/1984 | Gilbert | 123/522 |

*Primary Examiner*—Noah P. Kamen

*Attorney, Agent, or Firm*—Troutman Sanders; Joel S. Goldman; John A. Savio, III

[57] ABSTRACT

The present invention relates to a system for delivering an air-fuel mixture to an internal combustion engine in a virtually complete gaseous form. The system is essentially comprised of a converter which dries intake air and combines the dried air with gas vapor and an air modulator for adding additional atmospheric air to the air-gas vapor mixture. The convertor contains an activated charcoal substance which enhance evaporation of the fuel, prevents "gumming" of the fuel in the convertor, and inhibits condensation of the fuel after evaporation. The air-gas vapor mixture is then fed to an internal combustion engine. In a first embodiment, the system may be installed as an add-on apparatus to an automotive engine which already uses fuel injection as fuel feeding means. In that embodiment, disabling means are installed to disable the fuel injectors. In a second embodiment, the system may be utilized as original equipment for feeding an air-fuel vapor mixture to an internal combustion engine.

21 Claims, 4 Drawing Sheets

APPARATUS FOR DELIVERING A VOLATILE COMBUSTIBLE VAPOR AND ATMOSPHERIC AIR MIXTURE TO INTERNAL COMBUSTION ENGINES

BACKGROUND OF THE INVENTION

1. Technical Field

This invention relates generally to the gasification of liquid fuels and, more particularly, to the gasification of petroleum, alcohol, and other combustible liquids for mixture with atmospheric air for combustion in internal combustion engines.

Most fuel injected into a combustion chamber of an internal combustion engine does not burn in the combustion chamber. For example, only about 29–30% of gasoline undergoes combustion in conventional fuel injected automobile engines. Most of the unburned fuel passes through the exhaust manifold and is burned in a catalytic converter. Standard fuel injection systems do not vaporize fuel, but atomize the fuel into small enough droplets so as to allow some of the liquid droplets to burn upon ignition. Although atomization increases the surface area exposed to a spark or other burning gases, the fuel is still in a liquid form. A volatile fuel such as gasoline, for instance, is much more explosive when in a purely gaseous form since the combustion rate of a gas is much greater than that of a liquid. Much of the atomized fuel must absorb energy to overcome the latent heat of vaporization to become a gas. Thus, during the ignition process, a portion of the liquid gasoline actually burns at lower combustion rate than vaporized gasoline. Furthermore, much of the atomized gasoline simply absorbs the heat of combustion during ignition, vaporizes, passes through the exhaust manifold of the engine where it is finally burnt in the catalytic converter where temperatures reach in access of 5000° fahrenheit. Partial combustion of fuel results in low engine power performance and low fuel efficiency.

Another unfortunate result of incomplete combustion is the production of carbon monoxide. Thus, in addition to unburnt volatile fuel which escapes through the exhaust system, carbon monoxide is produced. The presence of these unwanted byproducts of incomplete combustion requires the addition of a catalytic converter to the exhaust system of the engine, sometimes including additional gas tubes which recycle unburnt gases from the catalytic converter back to the intake manifold of the engine. The addition of such equipment increases the cost and complexity of the engine system.

Accordingly, there is a need for a fuel system which facilitates complete gasification of liquid petroleum or other volatile fuel products so that a high percentage of combustion may occur immediately upon ignition, thereby increasing engine power output, fuel efficiency, and eliminating the need for equipment which reduces harmful emissions resulting from incomplete combustion.

2. Description of the Prior Art

Others have recognized the need to increase the efficiency of internal combustion engines while decreasing the amount of harmful gases produced as a result of incomplete combustion. Many approaches may be taken to increase combustion efficiency. For instance, U.S. Pat. No. 4,149,853 increases the percentage of fuel combustion by introducing organic reactive intermediates to an air-fuel mixture prior to ignition. There, reactive intermediates are generated from a suitable source compound, such as acetone. The acetone is exposed to ultraviolet light, converted to a short lived free radical, and combined with a heavier hydrocarbon molecule to create a longer-lived radical. The radicals are then introduced to the fuel before the ignition point, resulting in a very high percentage of burning of the fuel.

Others have attempted to increase the percentage of fuel combustion by highly atomizing the fuel just prior to ignition. For instance, U.S. Pat. No. 2,351,072 discloses a method of producing vaporous mixtures of air and a liquid in a finely divided state.

U.S. Pat. No. 4,426,984, discloses a generator for converting volatile combustible liquids, such as gasoline or methanol into an aeriform gas. The generator consists of a closed vessel containing liquid gasoline maintained at a predetermined level. The liquid gasoline is evaporated by allowing desiccated air to pass directly through the liquid. The air-gasoline mixture is then passed through a charcoal material which stabilizes the gas into an aeriform, which is fed into an internal combustion engine.

While others have attempted to increase the combustion efficiency of internal combustion engines, no such design has been developed which would increase the combustion efficiency to over 90% while reducing the fuel feed system complexity. By achieving those goals, power output and fuel efficiency are increased while harmful emissions and overall operating cost of the engine are decreased.

SUMMARY OF THE INVENTION

The present invention recognizes and addresses the foregoing disadvantages, and others of prior art constructions and methods.

Accordingly, it is an object of the present invention to increase combustion efficiency for an internal combustion engine.

It is another object of the present invention to increase fuel efficiency of an internal combustion engine.

It is another object of the present invention to simplify fuel delivery systems for internal combustion engines.

Still another object of the present invention is to reduce harmful emissions resulting from incomplete combustion.

Finally, it is another object of the present invention to eliminate the need for equipment which reduces harmful emissions resulting from incomplete combustion.

Generally speaking, the invention relates to a system for delivering an air-fuel vapor mixture to an internal combustion engine. The system is essentially comprised of a converter which dries intake air, vaporizes liquid fuel and combines the dried air with a fuel vapor; and an air modulator for adding additional atmospheric air to the air-fuel vapor mixture. The air modulator also includes variable restriction means for controlling a ratio of additional atmospheric air to the atmospheric air-fuel vapor mixture. The final air-fuel vapor mixture is then fed to an internal combustion engine from an air modulator outlet. In a first embodiment, the system may be installed as an add-on apparatus to an automotive engine which already uses fuel injection as a fuel feeding means. In that embodiment, disabling means are installed to disable the fuel injectors. In a second embodiment, the system may be utilized as original equipment for feeding an air-fuel vapor mixture to an internal combustion engine.

More specifically, a fuel vapor generator according to the present invention comprises a substantially closed container, a first inlet for feeding liquid fuel to the container, a liquid level regulating means for maintaining the liquid fuel at a predetermined level in the container, and a second inlet for feeding atmospheric air to the container. The second inlet includes a desiccant filter for removing moisture and debris from atmospheric air. The descant may consist of alumina ($Al_2O_3$) or any other substance which effectively removes moisture from atmospheric air. The convertor also contains an output port on the container located above the liquid fuel level maintained at a lower pressure than the second inlet, thereby allowing atmospheric air to pass through the filter. The convertor also contains vaporizing means for vaporizing the liquid fuel. The vaporizing means includes wicking means contacting the liquid fuel and extending above the predetermined liquid level, such that the demoisturized air passes through the wicking means, thereby vaporizing the liquid fuel in the desiccated air.

In accordance with the invention, the vaporizing means also includes stabilizing means for stabilizing the vaporized fuel. The stabilizing means contacts both the liquid fuel and wicking means, and prevents the fuel from fractionating while in liquid form during wicking, and also prevents the vaporized fuel from condensing back into a liquid form. The stabilizing means includes an activated charcoal is generally which is comprised of a bone charcoal that has been treated with a salt compound. The salt may be cupric chloride, nickel chloride, or silver chloride or any other metallic salt. When the stabilizing means is used with a hydrocarbon-based fuel, fractionation resulting from a variance in carbon chain length is prevented and condensation is virtually eliminated after vaporization, thus facilitating nearly complete combustion when the air-fuel vapor mixture is fed to an internal combustion engine.

Liquid fuel level within the converter is maintained using a float activated solenoid valve on the second inlet, or by any other known equivalent. Additionally, the wicking means may be an open-celled polyurethane foam or any effective wicking substance.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
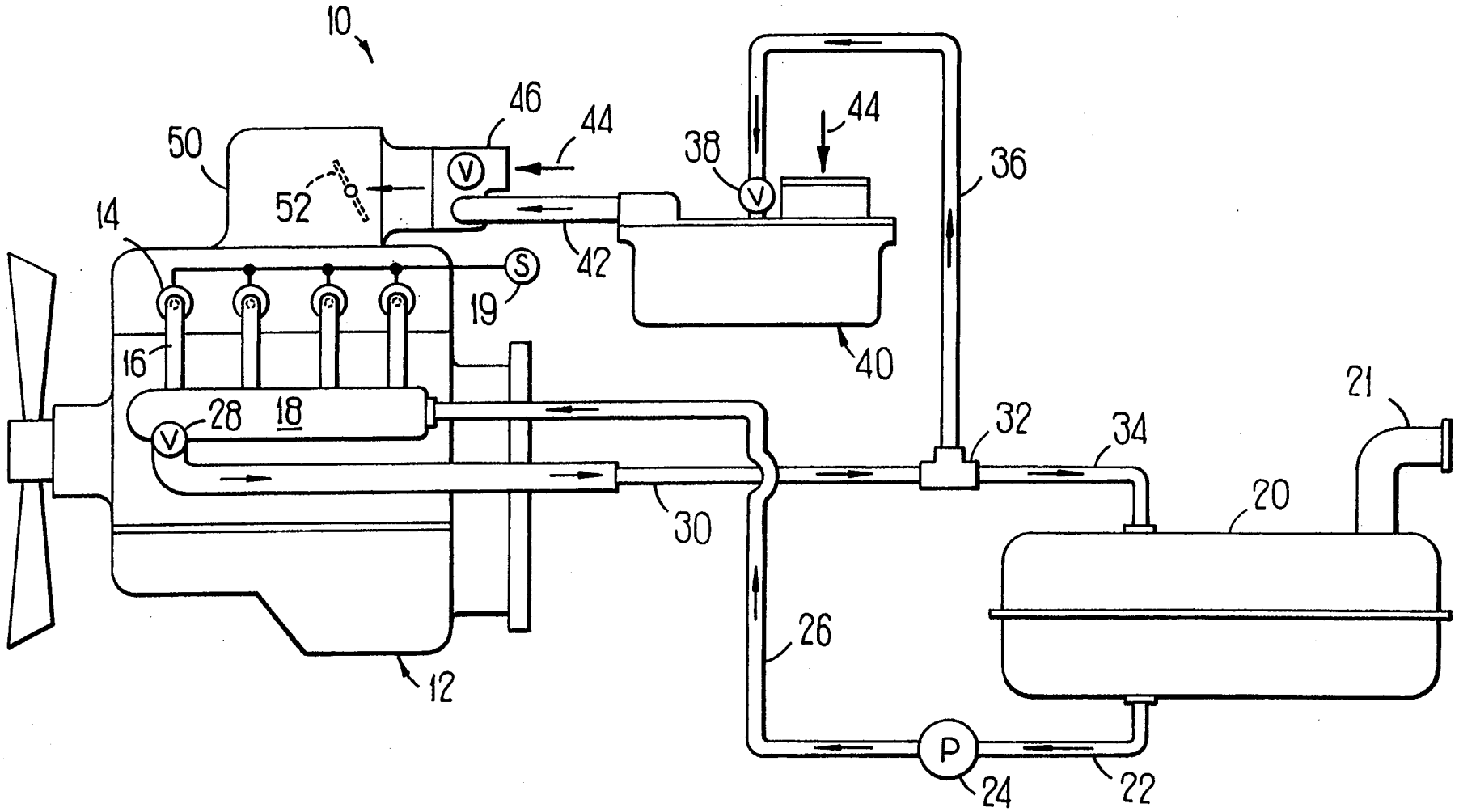
FIG. 1 is a schematic representation of the air-fuel mixture system according to the present invention.

Repeat use of reference characters in the present specification and drawings is intended to represent same or analogous features or elements of the invention.

DETAILED DESCRIPTION OF THE INVENTION

Referring now to FIG. 1, a schematic diagram illustrates the fuel vaporizing system according to a first embodiment of the present invention, generally designated by the numeral 10. System 10 is designed generally as an add-on device for an internal combustion engine 12 originally manufactured with solenoid operated fuel injectors 14. A switch 19 is installed for disabling the solenoids within the injector assemblies. System 10 is supplied with fuel such as gasoline from original tank 20. Low pressure supply line 22 is pressurized by in-line fuel pump 24. High pressure fuel line 26 feeds fuel rail 18 which supplies fuel to each of the injector assemblies 14. A pressure regulating valve 28 returns fuel to tank 20 via first return line 30.

Low pressure line 22, fuel pump 24, high pressure line 26, fuel rail 18, pressure regulating valve 28, and first return line 30 are components originally installed on the internal combustion engine 12. Furthermore, air intake 50 and butterfly valve 52 are also original equipment. Before the system 10 is installed, butterfly valve 52, normally linked to an accelerator pedal in an automobile as original equipment, controls the amount of air taken into engine 12. Furthermore, an air filter is normally mounted to air intake 50 as per manufacturer requirements; however, when the present invention is installed, air modulator 46 is placed between air intake 50 and the air filter.

Convertor 40 vaporizes the fuel and combines the vaporized fuel with desiccated dry air. Convertor 40 receives fuel from regulator 32. Regulator 32 receives fuel from first return line 30 at approximately 15 psi and allows fuel to pass to fuel line 36 at approximately 3 psi. The excess fuel returns to tank 20 via second fuel return line 34. Convertor 40 receives and dries atmospheric air 44, as will be discussed in greater detail below. The dried air is combined with fuel vapor and is fed via line 42 to air modulator 46. Air modulator combines further atmospheric air with the air-fuel vapor mixture created in convertor 40 and feeds the air-fuel vapor mixture to air intake 50 on engine 12. After system 10 is installed and the fuel injectors are disabled, butterfly valve 52 remains coupled to the engine accelerator, controls the volumetric rate of air-fuel vapor mixture fed to engine 12 for combustion, and also controls the ratio of fuel vapor to air (e.g., lean or rich), as will be discussed in greater detail below.

Figure 3:
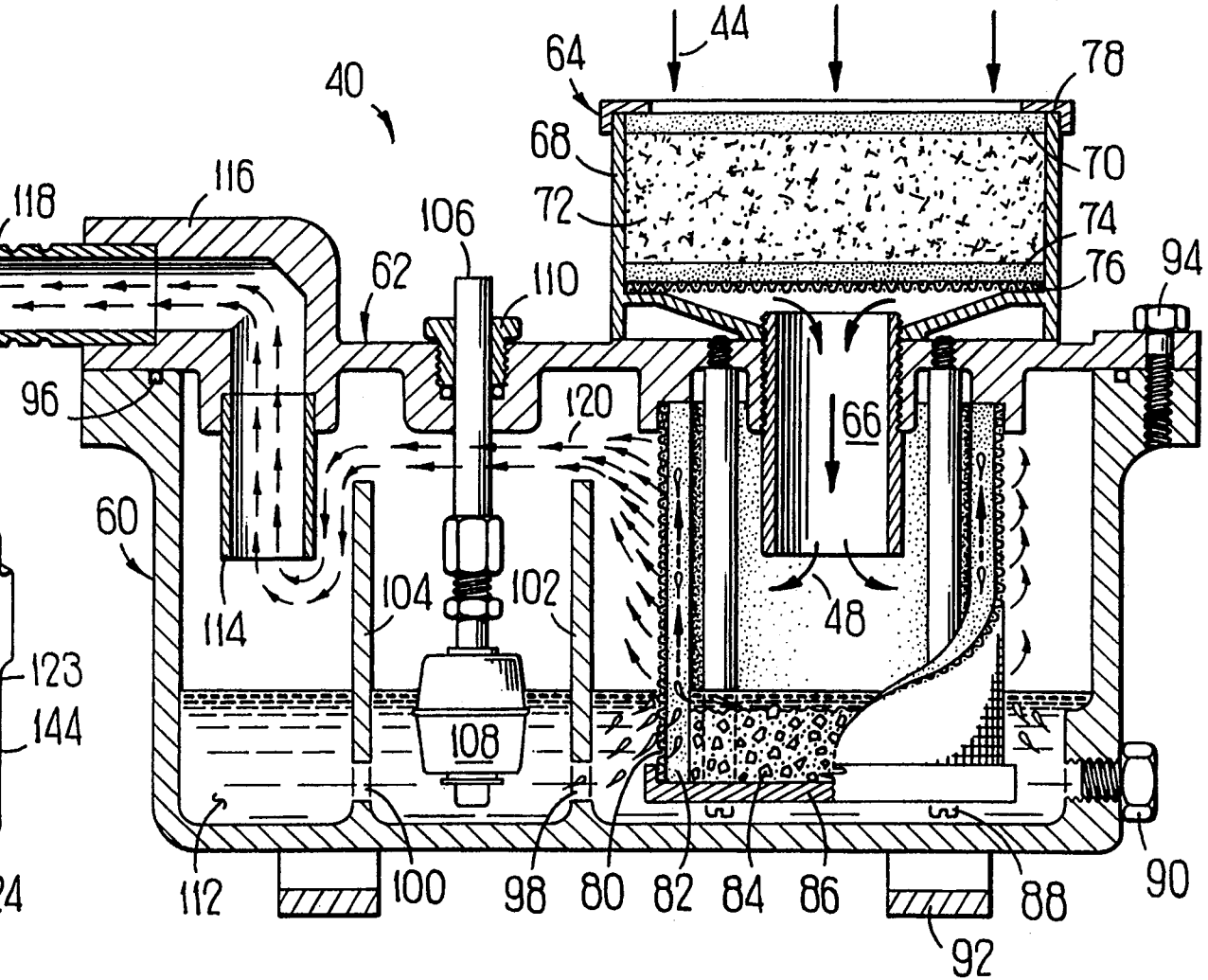
FIG. 3 is a cross sectional view of a fuel converter according to the present invention, illustrating fuel flow therethrough.
Figure 4:
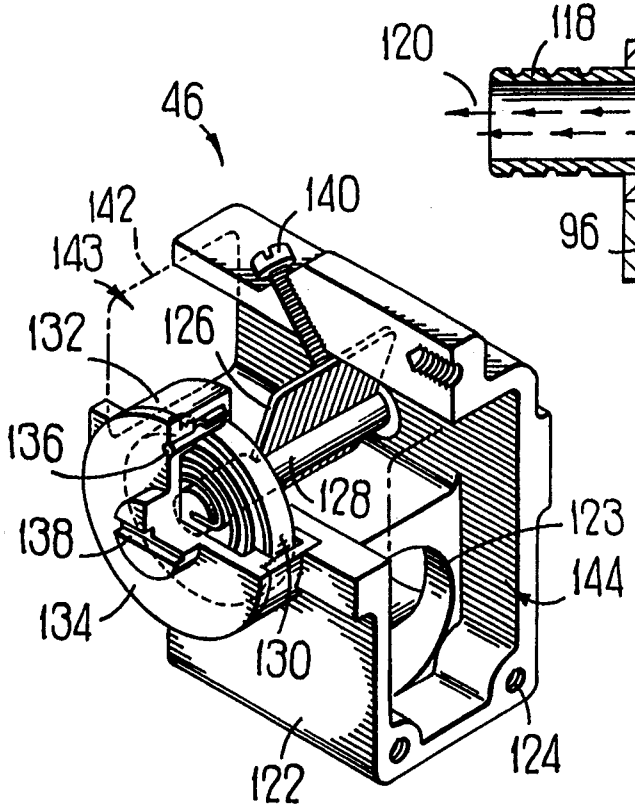
FIG. 4 is a top, rear, cut-away perspective view of the air modulator of FIG. 2.

Referring now to FIGS. 3 and 4, converter 40 and air modulator 46 are shown in cross section. Converter 40 includes a sealed metal container 60 having a removable cover 62. Cover 62 is fastened to container 60 by fastening bolts 94. Drain plug 90 is also fastened to a lower portion of container 60 for draining fuel from the converter when not in use. Sealing means are disposed between cover 62 and container 60. The container may be sealed using an O-ring placed in groove 96 or a gasket placed between the cover and container. Container 60 and cover 62 are fabricated from any suitable metal via casting or by any other known means of fabrication. Walls 102 and 104 are disposed opposite one another within container 60 and generally divide container 60 into three main chambers. A first chamber houses the wick 82 and activated charcoal 84, a second chamber houses float activated solenoid 106, and a third chamber provides an exit for gases 120.

Filter 64 is mounted onto cover 62 via sleeve 66. Sleeve 66 has a threaded outer portion so that it may threadingly mate to a hole in cover 62. Filter housing 68 also has a threaded center and is screwed onto sleeve 66. Filter 64 contains an desiccant 72 between foam layers 70 and 74 for removing moisture from incoming atmospheric air.

The desiccant may consist of alumina or any other known equivalent. For instance, calcium carbonate ($CaCo_3$), calcium sulfate ($CaSo_4$), silica gel, or molecular sieves may also be used within filter 64 to remove moisture from incoming atmospheric air. The grain size of alumina may be between 3–100 microns, but I have found that a size range of approximately 7–15 microns is the most effective in removing moisture from incoming atmospheric air. Screen 76 supports foam layer 74 such that foam 74 and desiccant 72 are not drawn into converter 40.

Within converter 40 a fuel wicking means is fastened to an inside portion of cover 62. Spacer bolts 88 support a circular lower support 86, and a tubular foam wick 82 is disposed between circular support 86 and a circular recess within cover 62. Wick 82 may be fabricated from any suitable wicking material, however, I have found that polyurethane foam having open cells of approximately 60 microns works best. Surrounding and supporting wick 82 is outer screen 80, which is also disposed between an outer lip of circular support 86 and cover 62.

Disposed at a lower portion of the cylindrical wick 82 is activated charcoal 84. The activated charcoal prevents fractionation of a liquid fuel into its individual constituents as will be discussed in greater detail below. The activated charcoal may be disposed between upper and lower screens to prevent charcoal particles from spreading out within the cylindrical space defined by the wick.

A float activated solenoid switch 106 is located in the second chamber of container 60 between walls 102 and 104. Float 108 activates or deactivates a solenoid operated valve 38, shown schematically in FIG. 2, to maintain a liquid level of fuel 112 flush with a top portion of the activated charcoal 84 or slightly above activated charcoal 84. Apertures 98 and 100 allow the liquid fuel level to equilibrate between the first, second, and third chambers. Inner outlet tube 114 is disposed in a circular recess within cover 62 and extends into the third chamber of container 62 and leads the demoisturized air-gasoline vapor mixture 120 through outlet port 116 and connection tube 118. Connection tube 118 provides a fastening point for line 42 between convertor 40 and air modulator 46.

Figure 2:
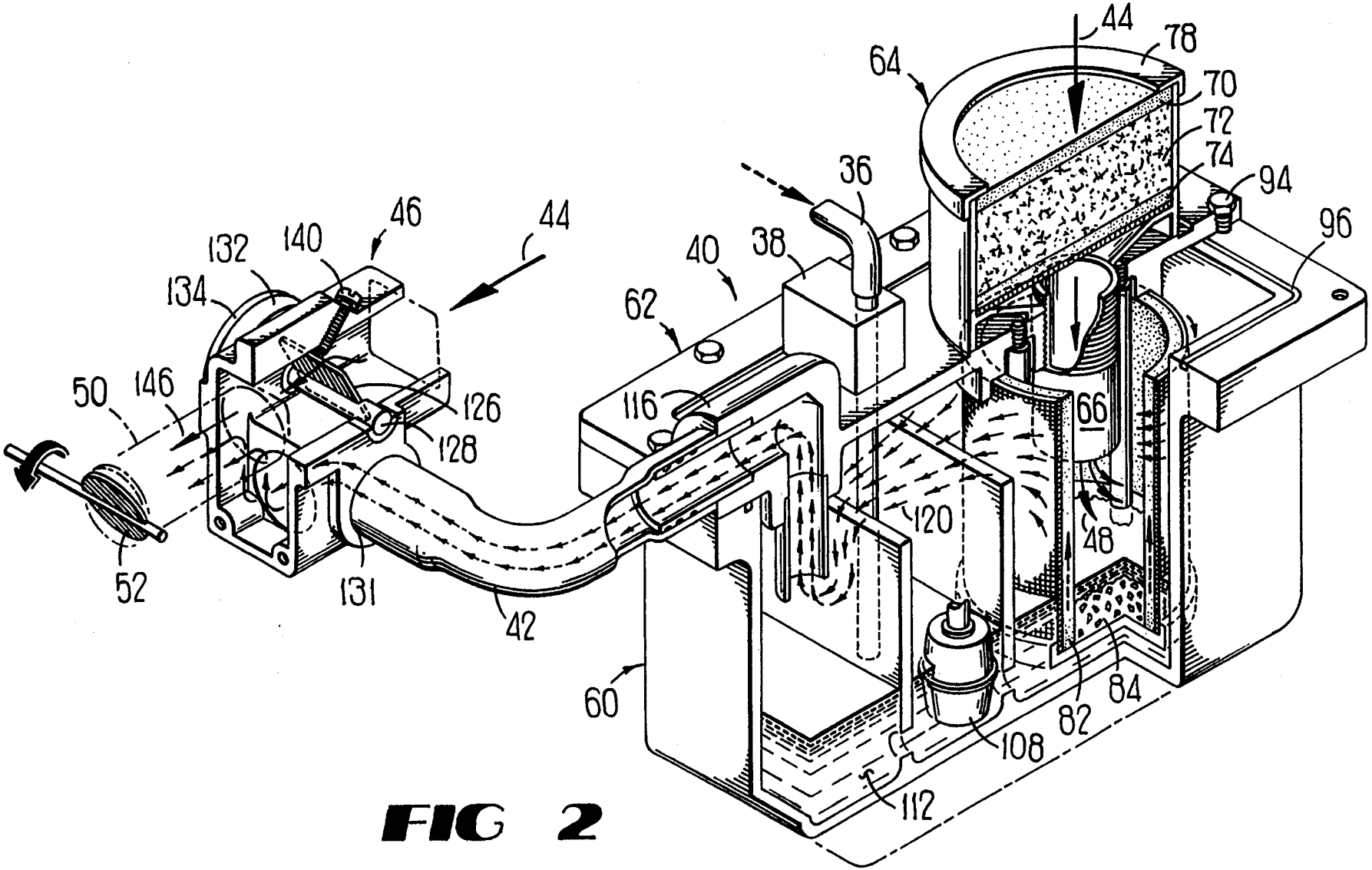
FIG. 2 is a top, front, right side, cut-away perspective view of a fuel converter and air modulator according to the present invention.

Line 42 allows a fluid connection between outlet port 116 of convertor 40 and air modulator 46, as seen in FIGS. 2 and 4, where further atmospheric air is mixed with the demoisturized air-gasoline vapor mixture 120. Demoisturized mixture 120 passes through line 42 to an inlet 131 of air modulator 46. Air modulator 46 consists of a main duct 143 along a top portion thereof. Disposed within duct 143 is a biased flapper valve 162. Valve 162 is rectangular in shape to fit within the square or rectangular cross section of duct 143. Valve 162 is rotatably mounted on shaft 128 in an offset manner and is biased against adjustment screw 140 by coil spring 130. A vacuum differential between inlet 142 and outlet 144 forces valve 126 open to allow atmospheric air 44 to mix with demoisturized mixture 112 passing through port 123 to create a final mixture 146 in port 144. Valve 52 is disposed between air modulator 46 and the intake manifold of the engine 12, is usually coupled to an accelerator pedal within an automobile, and controls the vacuum differential between ports 142 and 144 so as to control the concentration of gasoline vapor in the final mixture 146, as will be discussed in greater detail below.

FIG. 4 illustrates the adjustable biasing mechanism coupled to flapper valve 126. Spring 130 is disposed between housing portion 132 and 134. At an inside portion, spring 130 is engaged within a slot on shaft 128. An outside portion spring 128 is coupled to outer housing 134 by pin 136. Spring tension may be increased by inserting a screw driver into slot 138 on housing 134 and rotating housing 134 counterclockwise, and spring tension may be decreased by rotating housing 134 clockwise during an initial adjustment phase which will be discussed below. Additionally, threaded holes 124 may be used to fasten air modulator 46 to an intake portion of an internal combustion engine using standard bolts.

In operation, switch 19 disables solenoid-fuel injectors 14. Fuel pump 24 feeds fuel to fuel rail 18, and pressure relief valve 28 returns fuel to tank via line 30. In accordance with the present invention, valve 32 allows fuel to pass to line 36 at approximately 3 psi. Fuel line 36 fills container 60 of converter 40 with liquid fuel to approximately the height of the activated charcoal 86. A level of liquid fuel 112 is maintained by solenoid actuated valve 38. When float 108 reaches a first predetermined level, the solenoid closes valve 38. When the fuel level falls below a second predetermined level which is lower than the first predetermined level, float 108 opens valve 38 to fill container 60.

A vacuum created by the intake manifold of engine 12 draws air through filter 64 where nearly all moisture is removed by desiccant 72. As the fuel progresses up wick 82 by capillary action, it evaporates into the desiccated air 48 and creates a rich, demoisturized air-fuel vapor mixture 120. The vapor 120 passes over walls 102 and 104 and around inner outlet tube 114, such that each structure provides a tortuous path as indicated by the arrows representing mixture 120, thereby eliminating any large fuel droplets that may be present in the gas stream.

Mixture 120 then passes through line 42 to air modulator 46 where it is further mixed with atmospheric air 44, creating a final air-fuel vapor mixture which is then fed to the engine for combustion within the internal combustion chamber. When the device according to the present invention is installed in an automobile and the operator wishes to accelerate the vehicle, the operator depresses the accelerator, which opens butterfly valve 52. At that instant, the vacuum (or pressure) differential between air modulator inlet 142 and outlet 144 greatly decreases due to the low operating speed of the engine and the low vacuum created in the intake manifold, thereby allowing coil spring 130 to close valve 126 against adjustment screw 140, causing final mixture 146 to richen, and thereby providing greater combustion power to the engine, thus increasing the engine speed. As engine speed increases, volumetric flow to the intake manifold increases, and a larger vacuum differential is created between inlet 142 and outlet 144 which causes valve 126 to open, thereby leaning the final mixture 146. The tension of spring 130 is chosen by maintaining engine speed at approximately 6000 r.p.m. and the rotating outer housing 134. When valve 126 is completely open at approximately 6000 r.p.m., the correct spring tension has been reached. Set screw 140 is also adjusted to leave valve 126 slightly open such that engine 12 runs smoothly at idling engine speeds.

Figure 5:
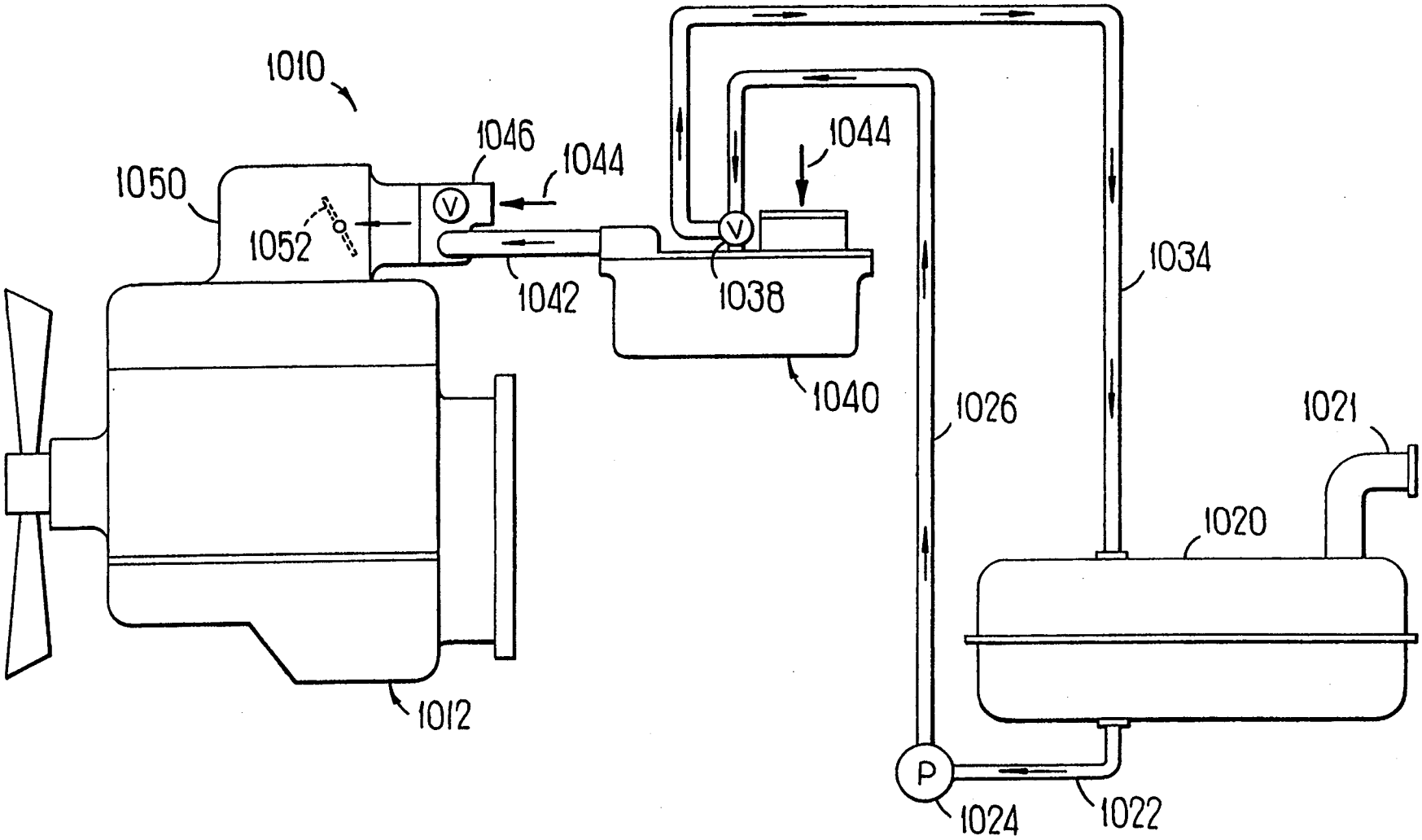
FIG. 5 is a schematic representation of a second embodiment of the present invention.

In a second embodiment of the present invention, system 1010 may be arranged as original equipment on an internal combustion engine, as illustrated in FIG. 5. There, fuel pump 1024 feeds fuel to solenoid actuated bypass valve 1038 via fuel line 1026. Convertor 1040 is identical to convertor 40 except that when valve 1038 sends excess fuel from line 1026 back to tank 1020 via return line 1034 when liquid fuel reaches the desired level within converter 1040. A dry air-fuel vapor mixture is fed via line 1042 to air modulator 1046 which works in a manner identical to that of air modulator 46. Additionally, intake manifold 1050 has a butterfly valve 1052 disposed therein which controls the amount of air fuel vapor fed to engine 1012. In this embodiment, no fuel injectors are needed since system 1010 is original equipment on engine 1012.

I have discovered that the activated charcoal prevents fractionation of liquid fuels in general, and is particularly effective with hydrocarbon fuels. For instance, a fuel such as gasoline is made from several different constituents including pentane, hexane, heptane, and octane. Each of these hydrocarbons has a different carbon chain length and consequently boiling temperatures that vary from approximately 105° to 165° Fahrenheit. The larger the molecular constituent, the higher its boiling point. This presents problems during evaporation. For instance, without the presence of the activated charcoal, when the fuel would progress up through wick 82 it would fractionate. When fractionation occurs, short hydrocarbon molecules or otherwise small molecular constituents have a greater rate of evaporation than larger hydrocarbon molecules or larger molecular constituents, leaving the larger hydrocarbon molecules in the wick in liquid form due to their longer chain length and elevated boiling points. I have discovered that the activated charcoal has the effect of equalizing the boiling points of each of the molecular constituents within the gasoline regardless of hydrocarbon chain length. This allows all molecular constituents to evaporate at an equal rate and thus eliminates "gumming-up" of the wick normally caused by large molecular weight residues when the activated charcoal is not used. Furthermore, I have found that the activated charcoal inhibits the vaporized gasoline molecules from condensing back into liquid droplets before they reach the combustion chamber of the engine 12. I have also discovered that when the activated charcoal is placed in liquid gasoline, the desired defractionating effect greatly enhances the overall evaporative rate of the gasoline.

The desiccant 72 also enhances the ability of the fuel to evaporate in convertor 40 since the partial pressure of water in the atmospheric air is virtually removed.

The chemical process for creating the activated charcoal is illustrated in the following example:

(a) Provide for a quantity of approximately 20–40 grams of animal bone charcoal of six to eight mesh.

(b) Provide for cupric chloride $CuCl_22(H_2O)$ crystals prepared in a solution of methanol with a ratio of 100 ml. methanol to about 50–170 grams of cupric chloride.

(c) Place the charcoal granules into an open vessel and pour in the dissolved cupric chloride-methanol solution onto the charcoal. Permit the saturation to take place for approximately 10 to 15 minutes.

(d) Remove the charcoal material from the solution and hot air dry the charcoal to evaporate the methanol using a heat gun or other equivalent heating means so as to allow cupric chloride salt crystals to remain in the granules of animal bone charcoal.

(e) Place the activated charcoal material in a sealed container to prevent any moisture accumulation until ready for use.

I have found that metallic salts work best in creating the activated charcoal. For instance, silver chloride and nickel chloride may also be used in step (b) of the example, but cupric chloride is preferred due to its low cost and effectiveness. Furthermore, I have found that lower alkyl alcohols are most effective in dissolving the metallic salt and provide for an excellent alcohol-metallic salt solution which readily penetrates the animal bone charcoal substance in step (b) of the example. Examples of lower alkyl alcohols which may be used as alternatives to methanol in step (b) of the example are ethanol, propanol, butanol, pentanol, and hexanol.

When retro-fitted to an automobile having a solenoid actuated fuel injection system, system 10 achieves a 90% evaporation rate of fuel in the convertor 40 and increases gas mileage of the automobile over the mileage when the same engine is operating on a fuel injection system. When the fuel delivery system according to the present invention is installed onto an automobile engine, virtually all of the fuel fed to the engine is burnt in the combustion chambers. Since combustion of the fuel is virtually complete, harmful emissions associated with incomplete combustion are eliminated. For example, the system according to the present invention meets all emission requirements set by the Environmental Protection Agency without the use of a catalytic convertor coupled to the engine exhaust system. Therefore, a catalytic convertor and associated tubes which feed unburnt gases from the convertor back to the intake manifold of the engine for recycling may be eliminated when the present invention is implemented. Furthermore, if the fuel delivery system according to the present invention is used as original equipment on an automotive engine, fuel injection equipment such as solenoids, rails, and associated fuel injection electronics may also be replaced by the present invention. Elimination of such equipment significantly reduces the cost of an automotive engine and simplifies engine maintenance.

It should be understood that various changes to the present invention may be made by the ordinarily skilled artisan, without departing from the spirit and scope of the present invention which is presented in the claims below. For instance, the invention may be used on a multitude of engines having any number of cylinders. It is also within the scope of this engine to employ alcohol based fuels or any other volatile liquid fuel which may be evaporated in convertors 40 and 1040. Furthermore, it is also within the scope of the invention to use other materials which may produce the same effect as activated charcoal 84 to enhance the evaporation of the fuel, prevent "gumming" of the fuel within the convertor, and inhibit condensation of the fuel when mixed with air and vaporized. The ordinarily skilled artisan will understand that this disclosure presents an example of the invention and is not meant to limit the invention, as presented in the claims, in any way whatsoever.

What is claimed is:

1. An apparatus for supplying an air-fuel vapor mixture to an internal combustion engine comprising:

a gas generator for producing a stable vapor from a volatile liquid fuel including;

a substantially closed container including, a first inlet means for feeding liquid fuel to said container, a second inlet for feeding atmospheric air to said container, vaporizing means for vaporizing the liquid fuel including, wicking means for vaporizing the liquid fuel in the air and for creating an air-fuel vapor mixture, stabilizing means for inhibiting fractionation of the vaporized fuel and for inhibiting the vaporized fuel from condensing back into a liquid form, means for maintaining the stabilizing means in contact with the liquid fuel, and said container further including an outlet for feeding the air-fuel vapor mixture to an internal combustion engine.

2. The apparatus of claim 1 wherein said second inlet includes:

a desiccant filter for removing moisture and debris from the atmospheric air; and an input port on said container near said filter for allowing demoisturized air from said filter into said container.

3. The apparatus of claim 1 wherein said stabilizing means includes a charcoal material treated with a metallic salt.

4. The apparatus of claim 1 wherein said stabilizing means includes a charcoal material treated with a material selected from a group consisting of cupric chloride, silver chloride, and nickel chloride.

5. The apparatus of claim 1 further including a liquid level regulating means for maintaining the liquid fuel at a predetermined level within said container.

6. The apparatus of claim 5 wherein said regulating means includes a float activated solenoid valve, wherein when said predetermined level of liquid fuel in said container is reached, said float activates said solenoid to close said first inlet.

7. The apparatus of claim 1 wherein said stabilizing means is adapted to be submerged in the liquid fuel.

8. The apparatus of claim 1 wherein said wicking means includes an open-celled foam polymer.

9. The apparatus of claim 8 wherein said wicking means is comprised of a polyurethane foam.

10. The apparatus of claim 8 wherein a cell size is approximately 60 microns.

11. The apparatus of claim 1 wherein the automobile engine includes a fuel injection system having a low pressure return liquid fuel line returning from fuel injectors to a liquid fuel source, said apparatus further including;

an inlet fuel line for connecting said first inlet to the low pressure return fuel line for supplying liquid fuel to said apparatus.

12. The apparatus of claim 1 further including:

an air modulator for mixing the air-fuel vapor mixture with additional atmospheric air including;

a first input port coupled to said gas generator outlet for receiving the air-fuel vapor mixture;

a second input port for receiving atmospheric air;

an output port coupled to an air horn of an internal combustion engine; and an outlet port for feeding the mixture of the air-fuel vapor mixture and the atmospheric air to the internal combustion engine.

13. The apparatus of claim 12 wherein said air modulator further includes variable restriction means for controlling a ratio of additional atmospheric air to the atmospheric air-fuel vapor mixture.

14. The apparatus of claim 13 wherein said restriction means includes a valve disposed near said second modulator input port.

15. The apparatus of claim 14 wherein said valve is a flapper valve biased into a substantially closed position.

16. The apparatus of claim 15 wherein said flapper valve opens in response to pressure differential between air horn inlet pressure and atmospheric pressure.

17. An apparatus for generating an air-fuel vapor mixture from liquid fuel and air comprising:

means for conducting liquid fuel into said apparatus;

means for vaporizing the liquid and for mixing the vaporized fuel and air within said apparatus;

stabilizing means for inhibiting fractionation of the vaporized fuel and for inhibiting the vaporized fuel from condensing back into a liquid form; and means for maintaining the stabilizing means in contact with the liquid fuel.

18. A method of fuel treatment comprising the steps of:

a) placing a stabilizing means in contact with liquid fuel so as to prevent fractionation of the fuel into individual constituents of the fuel in liquid form; and b) vaporizing the fuel in air to create an air-fuel vapor mixture, wherein said stabilizing means inhibits the condensation of the vaporized fuel back into liquid form.

19. The method of claim 18 further comprising the step of demoisturizing the air prior to mixing with the vaporized fuel.

20. The method of claim 18 further comprising the step of combining the demoisturized air-fuel vapor mixture with additional air to create a final air-fuel vapor mixture.

21. The method of claim 18 further comprising the step of combusting the air-fuel vapor mixture.

* * * * *